US008128455B2

(12) United States Patent
La Fontaine

(10) Patent No.: US 8,128,455 B2
(45) Date of Patent: Mar. 6, 2012

(54) ATTACHED CAPELET

(76) Inventor: Helen La Fontaine, Heathmont (AU)

( * ) Notice: Subject to any disclaimer, the term of this patent is extended or adjusted under 35 U.S.C. 154(b) by 299 days.

(21) Appl. No.: 12/526,516

(22) PCT Filed: Feb. 7, 2008

(86) PCT No.: PCT/AU2008/000171

§ 371 (c)(1),
(2), (4) Date: Aug. 10, 2009

(87) PCT Pub. No.: WO2008/109916

PCT Pub. Date: Sep. 18, 2008

(65) Prior Publication Data

US 2010/0017935 A1 Jan. 28, 2010

(30) Foreign Application Priority Data

Feb. 8, 2007 (AU) ..... 2007900628

(51) Int. Cl.
*A41C 3/00* (2006.01)

(52) U.S. Cl. ..... 450/36; 450/30; 450/33

(58) Field of Classification Search ..... 450/36–39, 450/54–58, 1, 7–11, 28, 30–33; 2/104–106, 2/113–114, 69, 96, 125, 126, 129, 130
See application file for complete search history.

(56) References Cited

U.S. PATENT DOCUMENTS

| | | | | |
|---|---|---|---|---|
| D128,990 | S | 8/1941 | Leser | |
| D139,390 | S | 11/1944 | Rubenstein | |
| 2,880,731 | A * | 4/1959 | Kendall | 450/30 |
| 3,064,265 | A * | 11/1962 | Bridgewaters | 2/74 |
| 6,059,633 | A | 5/2000 | Currier | |
| 6,645,041 | B2 * | 11/2003 | Sørensen | 450/36 |
| 6,839,908 | B2 * | 1/2005 | Schneider et al. | 2/73 |
| 6,854,132 | B1 * | 2/2005 | Polzin | 2/104 |
| 6,855,029 | B2 * | 2/2005 | Rothman | 450/36 |
| 6,983,489 | B2 * | 1/2006 | Caprio | 2/69 |
| 7,076,809 | B2 * | 7/2006 | Rothman | 2/104 |
| 7,077,720 | B2 * | 7/2006 | Schneider et al. | 450/36 |
| 7,186,163 | B2 * | 3/2007 | Carlucci | 450/28 |
| 7,448,090 | B2 * | 11/2008 | Lucock | 2/104 |
| 7,488,234 | B2 * | 2/2009 | Rothman et al. | 450/36 |
| 2004/0038621 | A1 | 2/2004 | Vera | |
| 2005/0085160 | A1 | 4/2005 | Johnstone | |
| 2007/0004314 | A1 * | 1/2007 | Carlucci | 450/30 |

FOREIGN PATENT DOCUMENTS

| | | |
|---|---|---|
| AU | 2004100586 | 8/2004 |
| WO | WO 02/30221 | 4/2002 |

* cited by examiner

*Primary Examiner* — Gloria Hale

(74) *Attorney, Agent, or Firm* — Galbreath Law Offices, P.C.; John A. Galbreath

(57) ABSTRACT

An attached capelet that does not necessitate the removal of the attached capelet from the wearer's body in order to access an under layer garment for breast feeding. The capelet (10) covers the shoulder strap and releasable fastener means of the under layer garment (12) when the wearer is not breast feeding. The capelet is attached to the under layer garment at a back portion or underneath the arm sections and covers each shoulder of the wearer with a hem line (28) extending from the neck to each underarm side (30) of the wearer.

12 Claims, 2 Drawing Sheets

(A)

(B)

ATTACHED CAPELET

FIELD OF THE INVENTION

This invention relates to a capelet that is attachable to an under layer garment where the under layer garment is adapted for breast feeding infants.

BACKGROUND OF THE INVENTION

A number of garments, such as singlets and dresses, are specifically adapted for breast feeding infants. Some garments are prefitted with bras, the straps of which can be detached to enable a cup of a bra and/or a breast portion of the garment to fold downwardly in order to enable an infant access to a breast for feeding.

However, none of these garments are able to be worn with a matching or contrasting attached capelet, such as a jacket, that need not be removed from the wearer's body when breast feeding of an infant. There is a need for a nursing mother to be able to wear an outer or further garment, in addition to an under layer garment, particularly to keep warm in cool weather and be able to breast feed an infant without removing the further garment.

The present invention seeks to overcome these disadvantages by providing an attached capelet that does not necessitate the removal of the attached capelet from the wearer's body in order to access an under layer garment for breast feeding.

SUMMARY OF THE INVENTION

According to a first aspect of the invention there is provided a capelet attachable to an under layer garment, the under layer garment adapted for breast feeding, wherein with the wearer wearing the attached capelet, in order to enable breast feeding the attached capelet is moved clear to allow access to the under layer garment and to a respective breast such that the attached capelet is not removed from the wearer's body.

The under layer garment may have releasably attachable shoulder straps through a fastener means. Bra cups of a bra may be part of the under layer garment. The shoulder straps may form part of a bra such that the under layer garment has no straps and the bra itself has the releasably attachable shoulder straps through a fastener means. The should straps may be adjustable to cater for changing breast size of the wearer.

The fastener means may be a clip, clasp, button and hole combination or a press stud combination or any other suitable fastener.

The attached capelet preferably covers the strap and fastener means between the strap and the under layer garment when the wearer is not breast feeding. The attached capelet is preferably attached to the under layer garment at a back portion and most preferably horizontally across a middle back portion which is substantially level with a line directly below the breasts.

Preferably, the attached capelet is stitched to the under layer garment. Alternatively, the attached capelet can be attached to the under layer garment at each side underneath the arm sections of the garments.

Preferably the attached capelet is a jacket and may have a variable sleeve length. The jacket may be made to the same colour and material type as the under layer garment. The jacket preferably covers each shoulder of the wearer with a hem line extending from the neck to each under arm side of the wearer.

According to a second aspect of the invention there is provided a capelet attachable to an under layer garment, the under layer garment adapted for breast feeding, the attached capelet having a hem or edge extending around the back of the neck of the wearer to the underside of each arm of the wearer, wherein in order to enable access to the under layer garment and to a respective breast for breast feeding, the respective side of the attached capelet is moved clear of a releasable fastener on the under layer garment.

According to a third aspect of the invention there is provided a first garment attachable to a second garment, the second garment adapted for breast feeding such that with a wearer wearing the first garment and the second garment and to enable breast feeding, the first garment is moved clear to allow access to the second garment and to a respective breast such that the first garment is not removed from the wearer's body.

According to a fourth aspect of the invention there is provided a garment comprising a first portion and a second portion, the first portion being attachable to a second portion, the second portion adapted for breast feeding such that with a wearer wearing the garment and to enable breast feeding, the first portion is moved clear to allow access to the second portion and to a respective breast such that the first portion is not removed from the wearer's body.

Preferably the first portion is an attached capelet such as a jacket and the second portion is an under layer garment such as a singlet or dress.

BRIEF DESCRIPTION OF THE DRAWINGS

A preferred embodiment of the invention will hereinafter be described, by way of example only, with reference to the drawings in which.

DETAILED DESCRIPTION OF THE PREFERRED EMBODIMENTS

Figure 1:
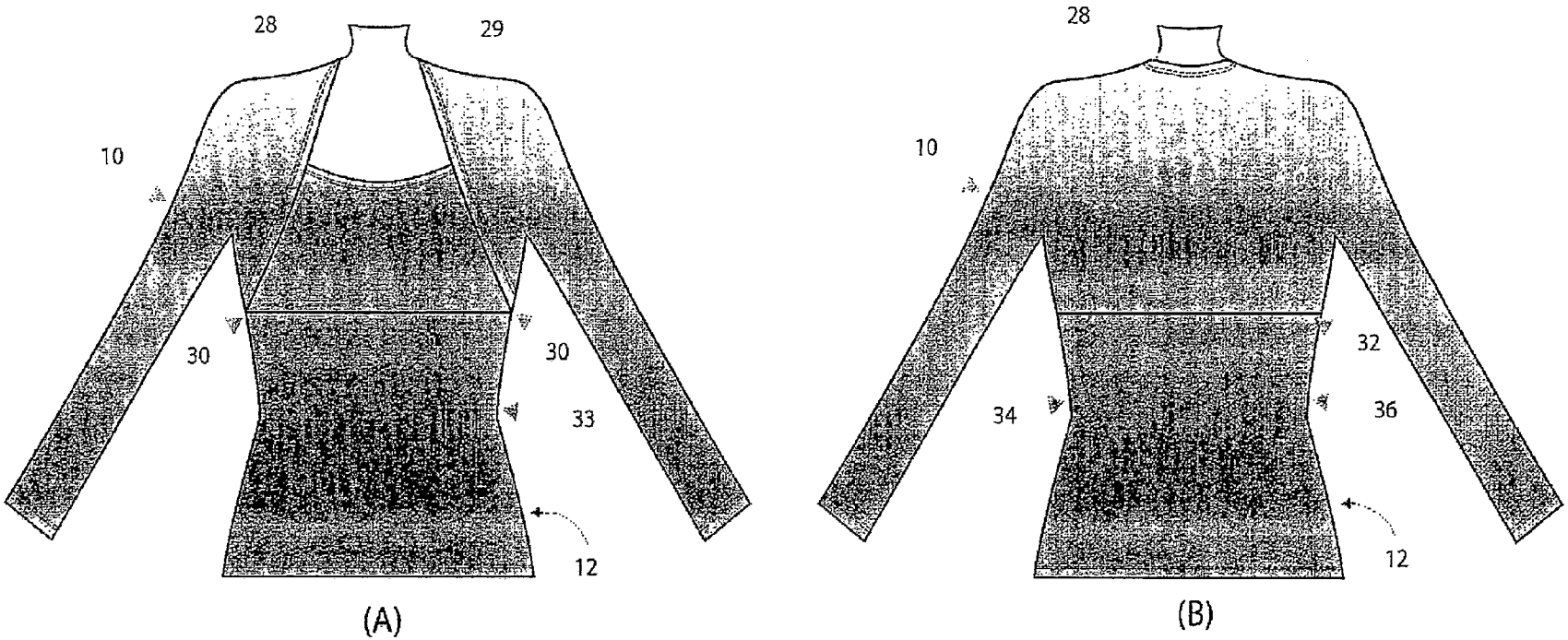
FIGS. 1A and 1B respectively show front and back views of an a capelet attached to an under layer garment according to an embodiment of the invention.
Figure 2:
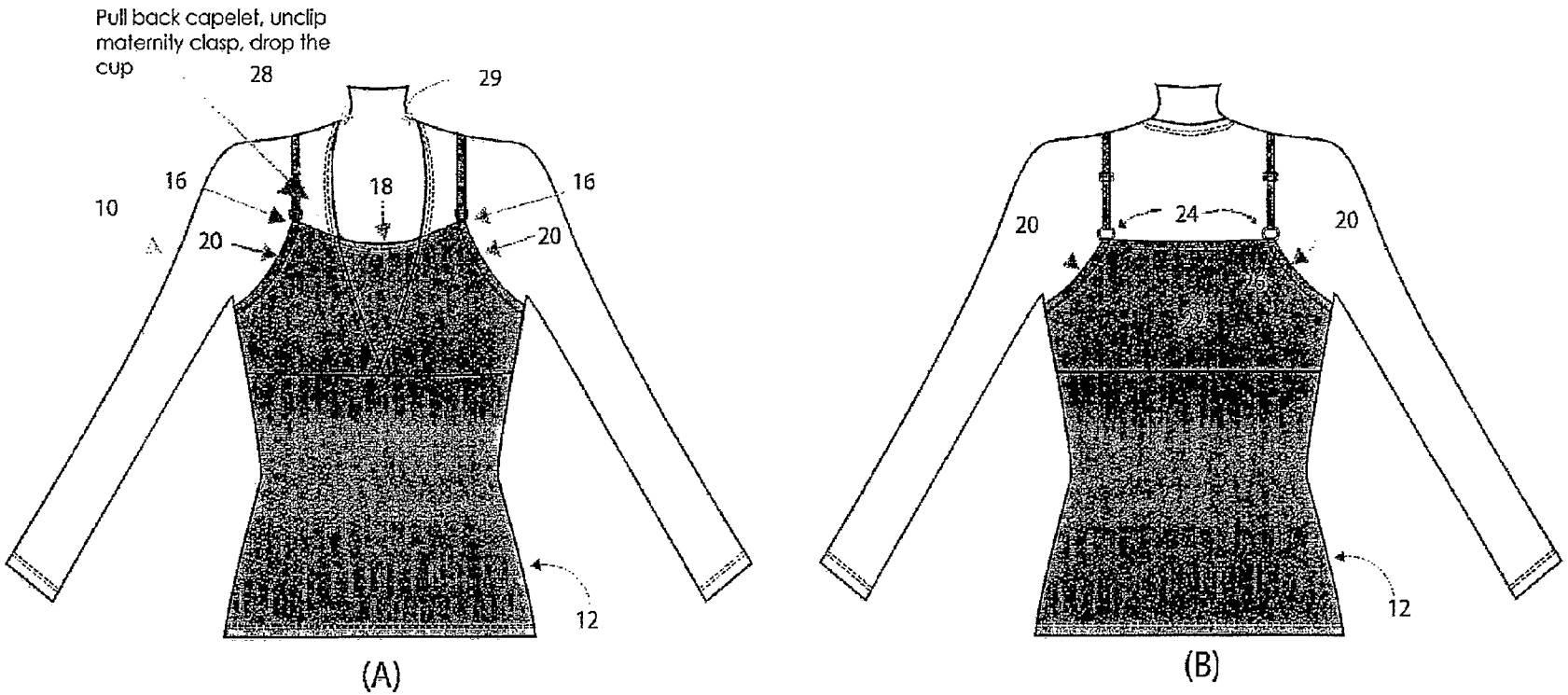
FIGS. 2A and 2B respectively show front and back views of an under layer garment and, in phantom, a capelet attached to the under layer garment, according to the embodiment of the invention.

With reference to FIGS. 1A and 1B there is shown an attached capelet 10 which covers a portion of under layer garment 12. The under layer garment 12, in this case in the form of a singlet, is more clearly seen in FIGS. 2A and 2E. The singlet 12 has a pair of shoulder straps 14 which are attached by connection means in the form or clasps 16 to join the straps 14 to the bust sections of the singlet 12. Specifically, the clasps 16 are located at a join between neck line section 18 and respective arm sections 20 of the singlet 12. The straps 14 are connected to a back panel 22 of the garment 12 through hooks 24, at a join between a back line 26 and each of the arm sections 20. Alternatively, the straps 14 can form part of a bra that has cups that are stitched into the bust sections, of the under layer garment 12, but not at a side seam, so that it enables easy access to a respective breast when breast feeding and infant.

The attached capelet, which is preferably a jacket, has a hemline 28 that extends from the back of the neck (see FIG. 1B) to a point 30 on each side of the wearer underneath the arms. Thus, the jacket 10 covers each shoulder, the straps 14 and any suitable connection means 16, such as a clip, clasp, button and hole combination or a press stud combination. The jacket 10 is attached at the back portion thereof to the under layer garment 12 at a seam 32 in line with seam 33 across the front of the singlet 12 underneath each breast. Alternatively, the jacket may be attached at each side 34 and 36 to the under layer garment.

In use, when tile wearer needs to feed an infant, she would pull back the respective hemline 28 or 29 of the jacket 10 towards the shoulder joint to enable access to the fastener 16. In the usual way the fastener 16 will then be unfastened to enable the part of the garment 12 covering the breast and any bra cup to fold downwardly to enable the infant to gain access to the breast.

Thus, it is seen that the wearer need not remove the entire jacket 10 in order to gain access to the under garment or singlet 12 but can simply have part of the jacket 10 that covers the shoulder moved slightly, just enough to gain access to the straps 14 and fastener 16.

The jacket 10 can be made to any sleeve length and can be made of any material type in any colour but is preferably matched to the material type and colour of the singlet or under garment 12. When the wearer has finished breast feeding or needs to change sides then it is a simple matter of reconnecting the strap through fastener 16, pulling the respective hemline 28 or 29 over the strap and fastener and there applying the same procedure as described above to the other side if required.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A garment for a wearer who breastfeeds, comprising:

a jacket with sleeves and breast covering parts;

the jacket attached to a bodice having a front adapted for breastfeeding and a back, the bodice extending from the wearer's armpits to below the wearer's waist;

the jacket being joined to the bodice by a horizontal seam which encircles at least the back of the bodice; and wherein the bodice has releasably attachable shoulder straps through fastener means and the jacket overlies the fastener means;

whereby in the event of breastfeeding the breast covering parts of the jacket are moveable clear of the bodice in the breast area, to allow access to the wearer's breast beneath without the need to remove the jacket from the wearer's body.

2. A garment as claimed in claim 1, wherein a breast-covering part of the bodice has bra cups, and said breast-covering part of the bodice can be folded downwardly for breastfeeding.

3. A garment as claimed in claim 1, wherein the bodice has a shelf bra.

4. A garment as claimed in claim 1, wherein the shoulder straps form part of a bra such that the bodice is devoid of straps and the bra has the releasably attachable shoulder straps connectable to the bodice by fastener means.

5. A garment as claimed in claim 1, wherein the straps are of adjustable length.

6. A garment as claimed in claim 1, wherein the jacket is joined to the bodice from a first side seam to a second side seam of the bodice across the bodice back.

7. A garment as claimed in claim 1, wherein the jacket covers the wearer's bust and has a neckline which extends from the back of the wearer's neck to a point on each side of the wearer, underneath the wearer's arms.

8. A nursing garment, comprising:

a bodice supported by releasably attachable shoulder straps with fasteners, the bodice having a front bust portion which can be folded downwardly for nursing, and a back, and a jacket joined to the bodice which covers at least part of the bust portion and the fasteners, the jacket being joined to the bodice by a substantially horizontal seam which encircles at least the back of the bodice.

9. A nursing garment as claimed in claim 8, wherein the jacket has sleeves.

10. A nursing garment as claimed in claim 8, wherein the shoulder straps are adjustable.

11. A nursing garment as claimed in claim 8, wherein the jacket is sleeveless.

12. A nursing garment as claimed in claim 8, wherein the bodice has a first side seam and a second side seam, and the jacket is joined to the bodice across the bodice back at least from the first side seam to the second side seam.

* * * * *